US009139259B2

(12) United States Patent
Williams et al.

(10) Patent No.: US 9,139,259 B2
(45) Date of Patent: Sep. 22, 2015

(54) FOLDING CARGO BIMINI TOP

(71) Applicant: Xtreme Marine Corporation, Maryville, TN (US)

(72) Inventors: Anthony Duane Williams, Maryville, TN (US); Bradley Michael Nemeth, Oak Ridge, TN (US)

(73) Assignee: Xtreme Marine Corporation, Maryville, TN (US)

( * ) Notice: Subject to any disclaimer, the term of this patent is extended or adjusted under 35 U.S.C. 154(b) by 0 days.

(21) Appl. No.: 14/204,164

(22) Filed: Mar. 11, 2014

(65) Prior Publication Data

US 2014/0261143 A1 Sep. 18, 2014

Related U.S. Application Data

(60) Provisional application No. 61/779,415, filed on Mar. 13, 2013.

(51) Int. Cl.
*B63B 17/02* (2006.01)

(52) U.S. Cl.
CPC ..... *B63B 17/02* (2013.01)

(58) Field of Classification Search
CPC .. B63B 1/00; B63B 2201/00; B63B 2203/00; B63B 17/02; B63B 2017/026
See application file for complete search history.

(56) References Cited

U.S. PATENT DOCUMENTS

| | | | |
|---|---|---|---|
| 5,918,613 | A | 7/1999 | Larson |
| 6,257,261 | B1 | 7/2001 | Johnson |
| 6,327,993 | B1 | 12/2001 | Richens |
| 6,666,159 | B2 | 12/2003 | Larson |
| 6,691,637 | B1 | 2/2004 | Smith |
| 6,755,332 | B2 | 6/2004 | Crane |
| 6,799,529 | B1 | 10/2004 | Willis |
| 8,025,194 | B2 | 9/2011 | Jesewitz |
| 8,297,484 | B2 | 10/2012 | Jesewitz |
| 8,567,651 | B2 | 10/2013 | Jesewitz |
| 2005/0194414 | A1 | 9/2005 | Lynch |

*Primary Examiner* — Edwin Swinehart
(74) *Attorney, Agent, or Firm* — Luedeka Neely Group, P.C.

(57) ABSTRACT

A folding bimini top having a vertical arch member that may be pivotally raised and lowered or released relative to a boat hull, and a lateral support member that can receive a sun cover or cargo, and which has a first portion pivotally connected to the arch member and a second portion that releasably connects to the arch member via a latch.

10 Claims, 13 Drawing Sheets

FOLDING CARGO BIMINI TOP

CROSS-REFERENCE TO RELATED APPLICATION

This application claims priority to U.S. Provisional Application No. 61/779,415, filed Mar. 13, 2013, entitled Folding Cargo Bimini Top, incorporated herein by reference in its entirety.

FIELD

This disclosure relates to tops for boats. More particularly, the disclosure relates to a folding frame for a top of improved construction and strength.

BACKGROUND

Bimini tops are canopy-like structures that fit over the cockpit of a boat. The top is provided by a frame over which is secured a fabric or vinyl sheeting that provides sun protection. It is desirable to have a frame that can be folded so that the top can be out of the way if desired to have full sun, or for towing or storing of the boat. Known folding bimini tops have various disadvantages, especially in regards to strength. Accordingly, improvement is desired in the provision of folding bimini tops, especially in the provision of a folding bimini top having sufficient strength so that the top can be used to store boating cargo such as tubes, skis, surfboards, wakeboards, and the like.

The disclosure advantageously provides a folding bimini top of improved construction. In one aspect of the disclosure, the top includes a vertical arch member that may be pivotally raised and lowered or released relative to a boat hull, and a lateral support member that can receive a sun cover or cargo, and which has a first portion pivotally connected to the arch member and a second portion that releasably connects to the arch member via a latch.

SUMMARY

The disclosure relates to a folding frame for a boat, the frame comprising:

In one aspect, the folding frame includes a vertical arch member that may be pivotally raised and lowered or released relative to a boat hull, and a lateral support member that can receive a sun cover or cargo. The lateral support has a first portion pivotally connected to the arch member and a second portion that releasably connects to the arch member via a latch.

In another aspect, the folding frame includes a vertical arch member that may be pivotally raised and lowered or released relative to a boat hull; a lateral support member that can receive a sun cover or cargo, and which has a first portion pivotally connected to the arch member and a second portion that releasable connects to the arch member; and a latch associated with the frame for releasably latching the lateral support and the arch member together so that the lateral support is fixed from pivoting relative to the arch member.

The frame is positionable between a deployed position in which the arch member oriented in an upright or non-folded position, and the lateral support oriented to be generally horizontal and latched to the arch member, a loading position in which the arch member is oriented in an upright or non-folded position, and the lateral support is unlatched from the arch member and pivoted away from the arch member so that a rearward edge of the lateral support is pivoted downwardly, and a stowed position in which the arch member is folded to a lowered or non-upright position, and the lateral support positioned to be generally horizontal and latched to the arch member so as to position the frame in a vertically compact orientation.

Frames according to the disclosure advantageously enable a strong, but foldable design. A lateral support of the frame may be easily raised and lowered for storing and retrieving cargo, and a vertical arch member of the frame may be easily be raised or lowered to facilitate storage of the boat.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
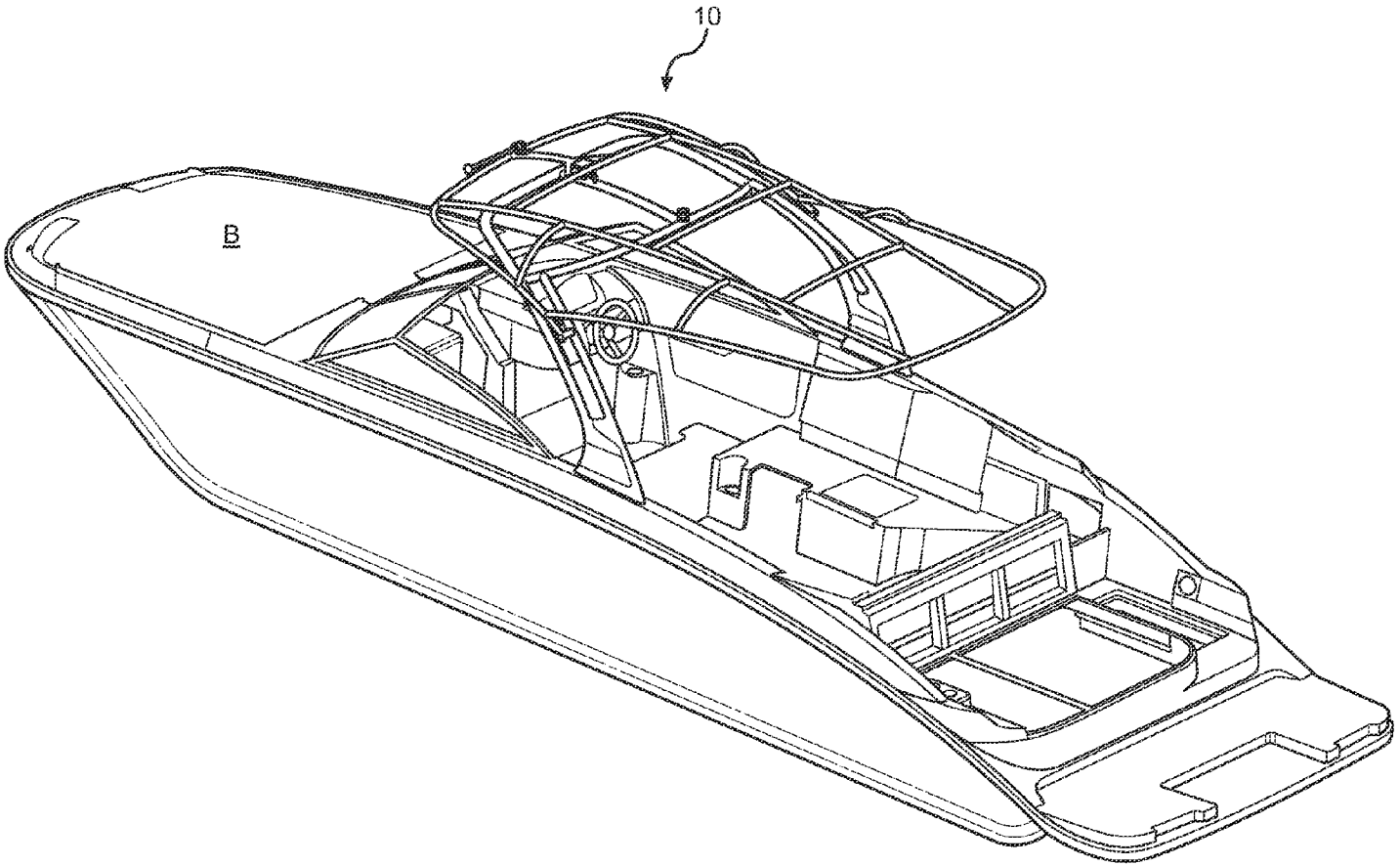
FIG. 1 shows a folding frame for a boat according to the disclosure and oriented in a deployed position on a boat.
Figure 2:
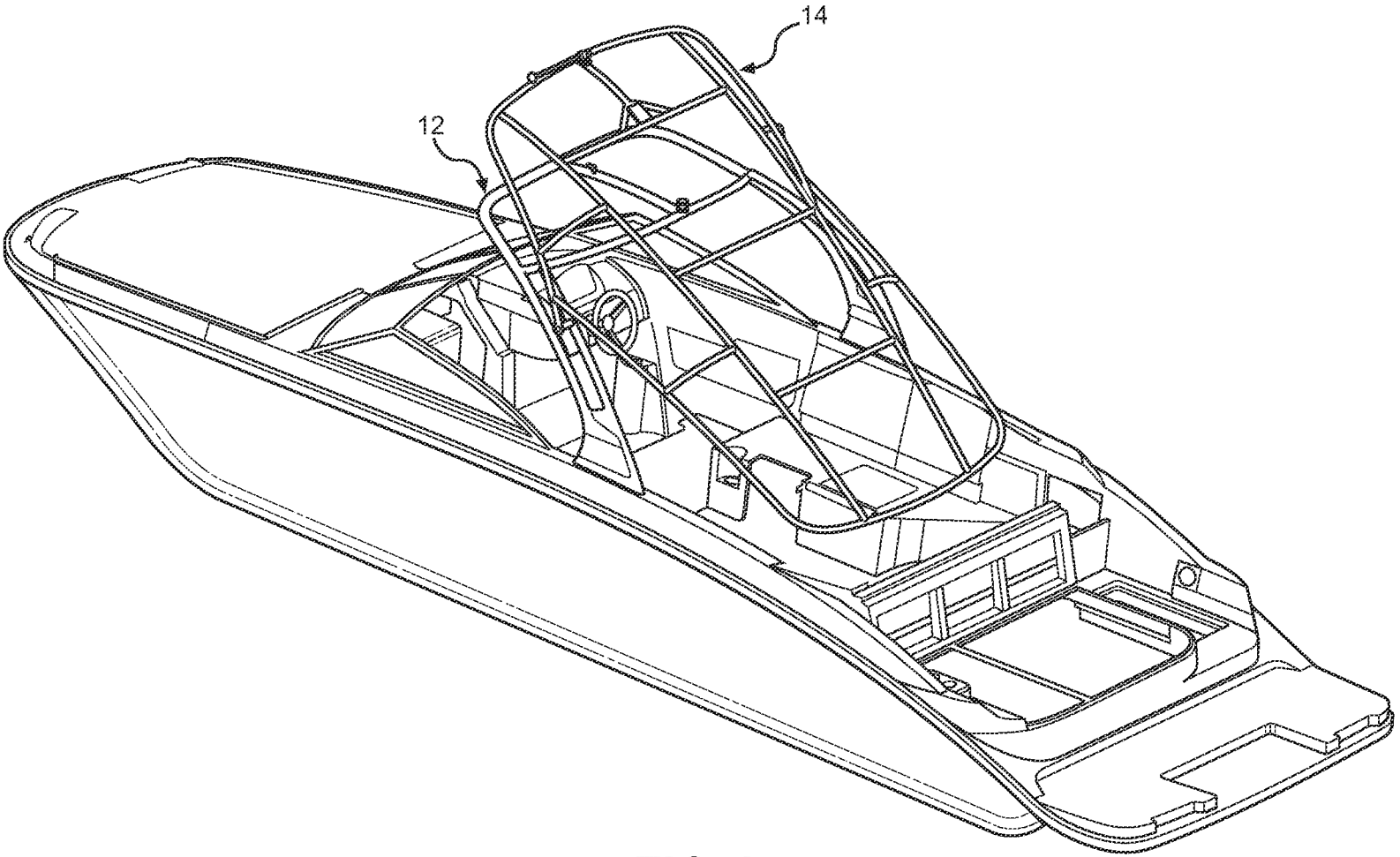
FIG. 2 shows the folding frame of FIG. 1 oriented to facilitate loading of cargo thereon.
Figure 3:
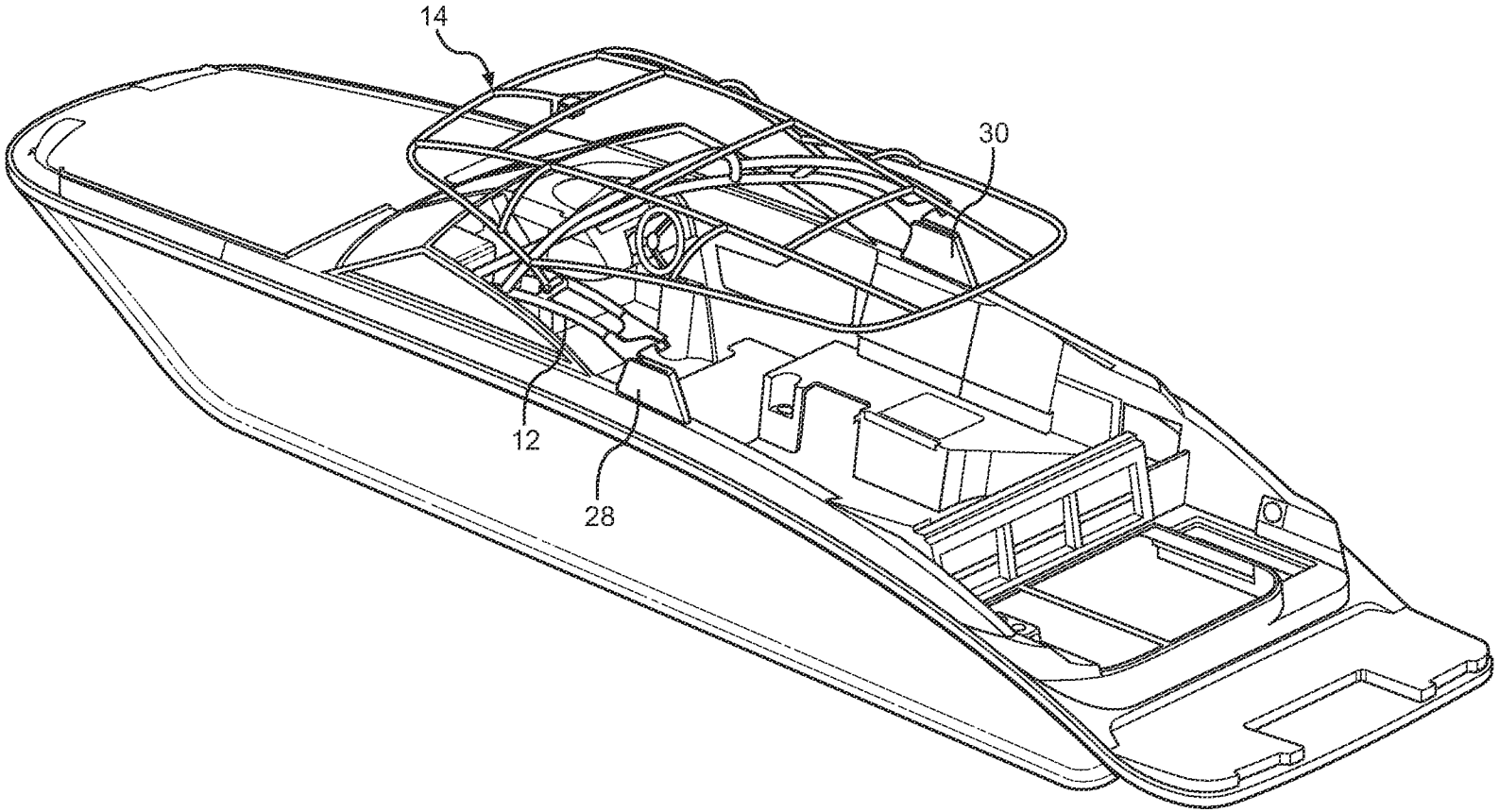
FIG. 3 shows the folding frame of FIG. 1 oriented in a stowed position.

With reference to the drawings, the disclosure relates to a folding frame 10 that can be configured for use with various boat styles. FIGS. 1-3 show the frame 10 installed on a boat B. The frame 10 also has desirable aesthetics in that it mimics the appearance of a wakeboard tower. In some embodiments, the frame 10 is sufficiently strong to be suitable for towing purposes, such as for skiers and wakeboarders. The frame 10 can also be used to support a cover such as a sunshade. The frame 10 may also be used to store cargo, such as wakeboards, surfboards, tubes, and the like.

The frame 10 is advantageously configured to be able to be folded between various orientations for various purposes. The folding feature facilitates loading/removal of cargo from the frame while an arch portion of the frame remains upright. In a fully deployed orientation the frame 10 is useful as a cover or top, such as to carry cargo and support a bimini cover. The folding feature also enables a compact orientation to facilitate storage of a boat having the frame 10.

The frame 10 includes a vertical arch member 12 and a lateral support 14, each of which may be selectively foldable. In some embodiments, the vertical arch member 12 is foldable or pivotable relative to the boat B. However, in other embodiments, the vertical arch member 12 may be fixedly mounted to the boat B. The lateral support 14 is foldable or pivotable relative to the vertical arch member 12, and may be latched to or unlatched from the arch member 12 by use of a latch system 16. The frame 10 may include internal wiring and a mount for mounting navigation lighting, such as a foldable light 18.

Figure 4:
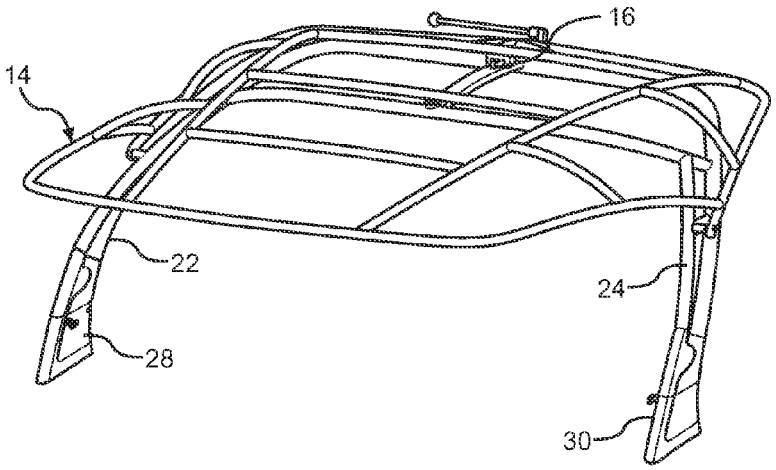
FIG. 4 shows the frame as shown in FIG. 1 without the boat.

FIGS. 1 and 4 show the frame 10 in a deployed position. The arch member 12 is in an upright or non-folded position, and the lateral support 14 positioned to be generally horizontal and latched to the arch member 12 using the latch system 16. This orientation of the frame 10 is selected during use of the boat B, with the frame 10 being oriented so that the arch member 12 may be used as a wakeboard tower, and to position a sun cover to shade occupants from the sun.

Figure 5:
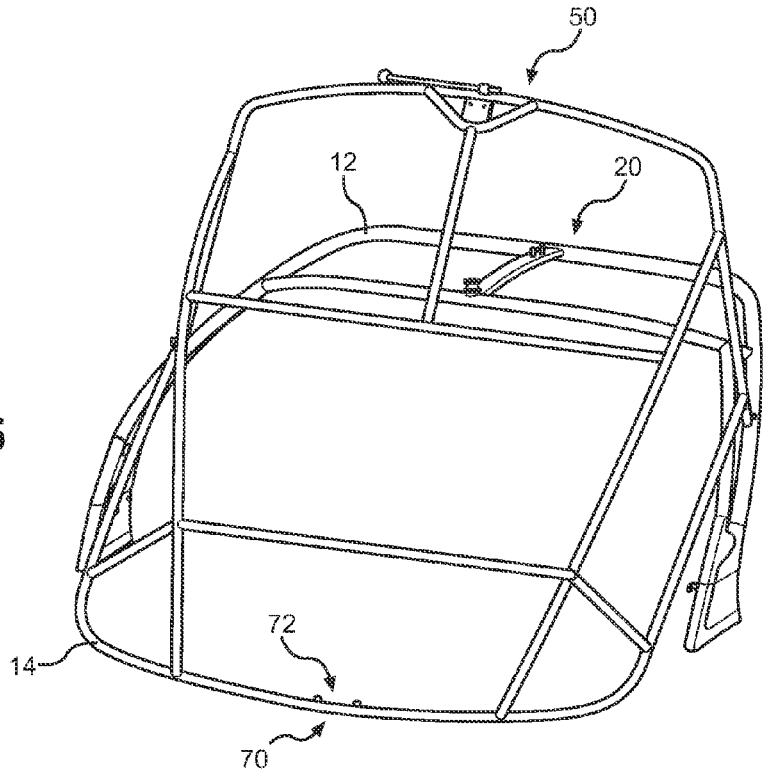
FIG. 5 shows the frame as shown in FIG. 2 without the boat.

FIGS. 2 and 5 show the frame 10 in a loading position. The arch member 12 is in an upright or non-folded position, and the lateral support 14 is unlatched from the arch member 12 and pivoted away from the arch member 12. In this orientation, a rearward edge of the lateral support 14 is pivoted downwardly toward the cabin area of the boat B. This orientation of the frame 10 is selected to facilitate loading of cargo such as wakeboards and the like onto the frame 10.

Figure 6:
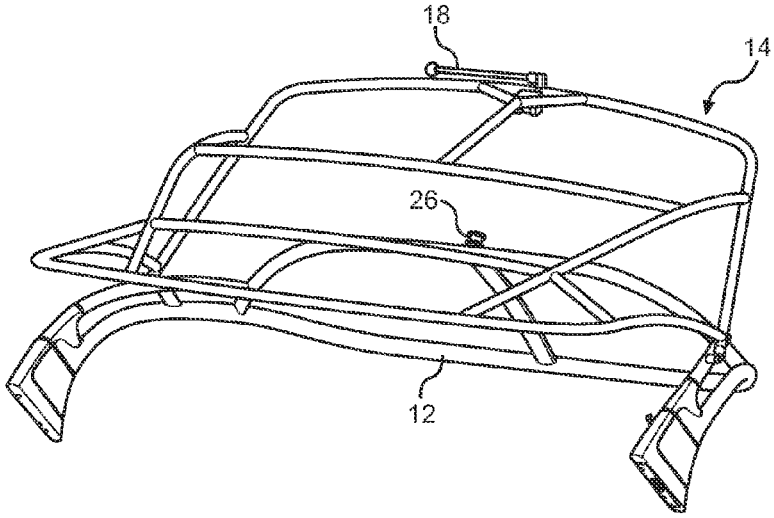
FIG. 6 shows the frame as shown in FIG. 3 without the boat.
Figure 7:
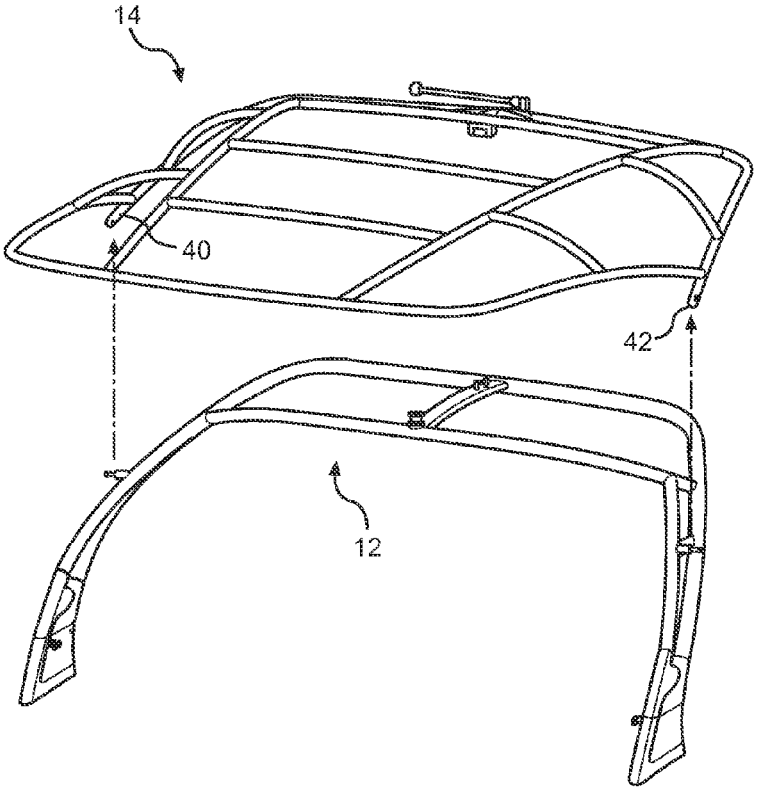
FIG. 7 is an exploded view of the frame of FIG. 1.

FIGS. 3 and 6 show the frame 10 in a stowed position. The arch member 12 is folded to a lowered or non-upright position. The lateral support 14 may be positioned to be generally horizontal and, in certain embodiments, latched to the arch member 12 when in the stowed position. This orientation of the frame 10 is selected to position the frame 10 in its most vertically compact orientation. This orientation is desirable for storing the boat B having the frame 10 thereon.

The arch member 12 provides a rigid arch-shaped structure when erected and includes a crosspiece 20 extending between a pair of legs 22 and 24. A tow point 26 may be centrally located on the crosspiece 20. The components of the arch 12 may be made of aluminum, composite, or other rigid materials. The components of the arch 12 are generally configured in the shape of an arch mountable to a boat hull so as to extend in a forward or bow direction, rising along its length, when in the fully erected orientation, such as shown in FIG. 1.

Figure 14:
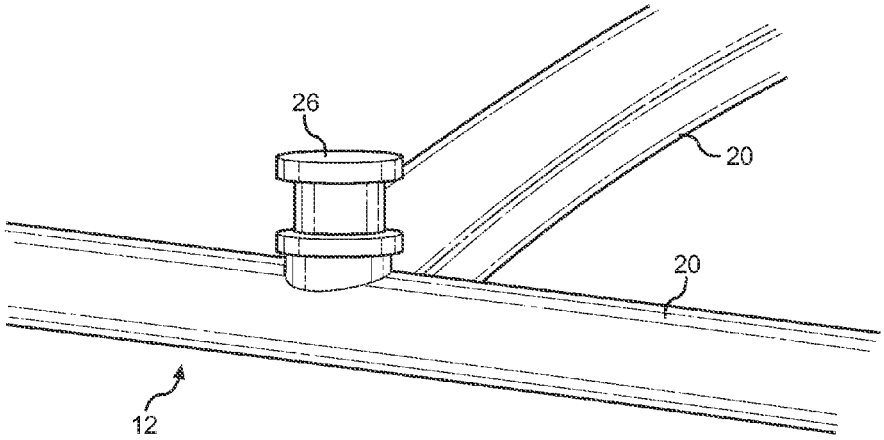
FIG. 14 shows a tow point mounted on the vertical arch.

In certain embodiments, the legs 22 and 24 are pivotally mounted relative to the boat B. For example, the lower ends of the legs 22 and 24 may be pivotally mounted to bases 28 and 30 secured to the boat B, with the leg 22 and the base 28 shown in detail in FIGS. 14 and 15. For example, the base 28 is attached to the boat B as by fasteners. In the illustrated example, the base 28 is attached to the gunwales of the boat. In other embodiments, the base may be attached to the deck or be integral with or attached to the windshield, seats, or other portions of the boat B.

Figure 15:
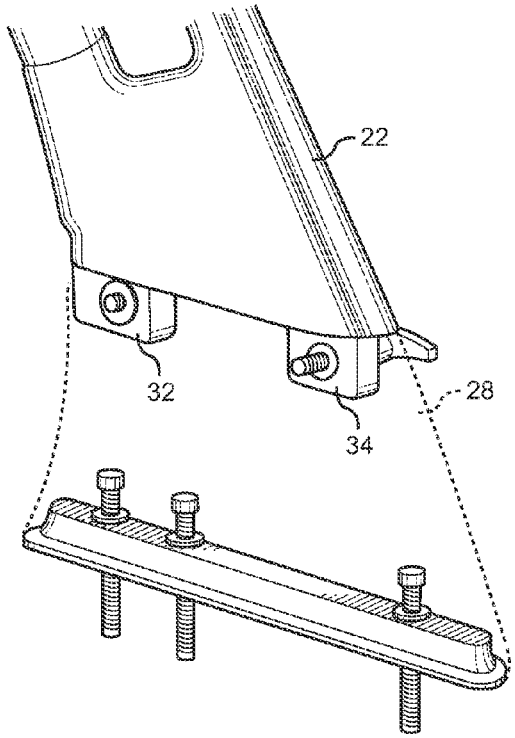
FIGS. 15 and 16 show a base assembly mountable to a boat hull and onto which the vertical arch is pivotally mounted.
Figure 16:
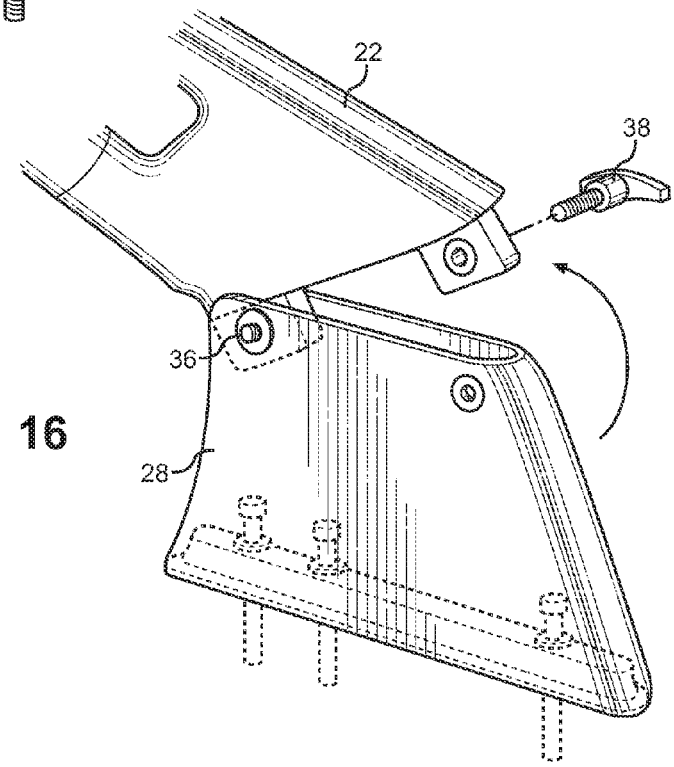

The lower end of the leg 22 includes a leading tab 32 and a trailing tab 34 that each seat into the base 28. The leading tab 32 is pivotally mounted to the base 28 as by a bolt 36 that extends through aligned threaded apertures of the base 28 and the tab 32. The trailing tab 34 is similarly configured and attaches to the base 28 as by a removable threaded pin 38. Thus, to secure the leg 22 in an upright position, the leg 22 is seated in and secured to the base 28 with the bolt 36 and the threaded pin 38. To fold the leg 22 to a lowered position, the pin 38 is removed to release the tab 34 from the base 28, and the leg may be pivoted about the bolt 36 as shown in FIG. 15. The leg 24 is similarly configured to cooperate with the base 30.

Figure 8:
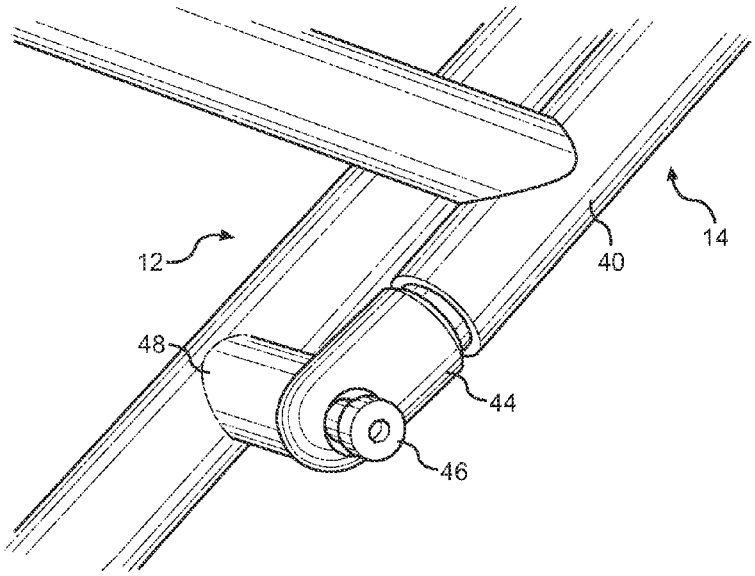
FIG. 8 is a close-up view of a pivotal connection between a vertical arch component and a lateral support component of the frame of FIG. 1
Figure 9:
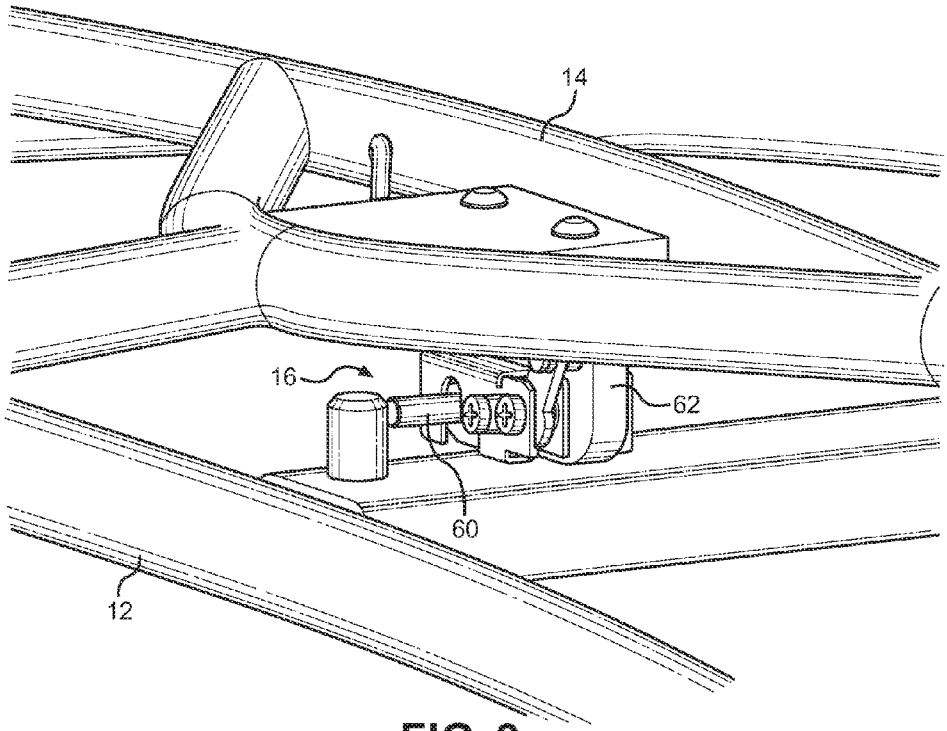
FIGS. 9 and 10 are closeup views showing a latch used to latch the lateral component of the frame of FIG. 1 to the vertical arch component of the frame.
Figure 10:
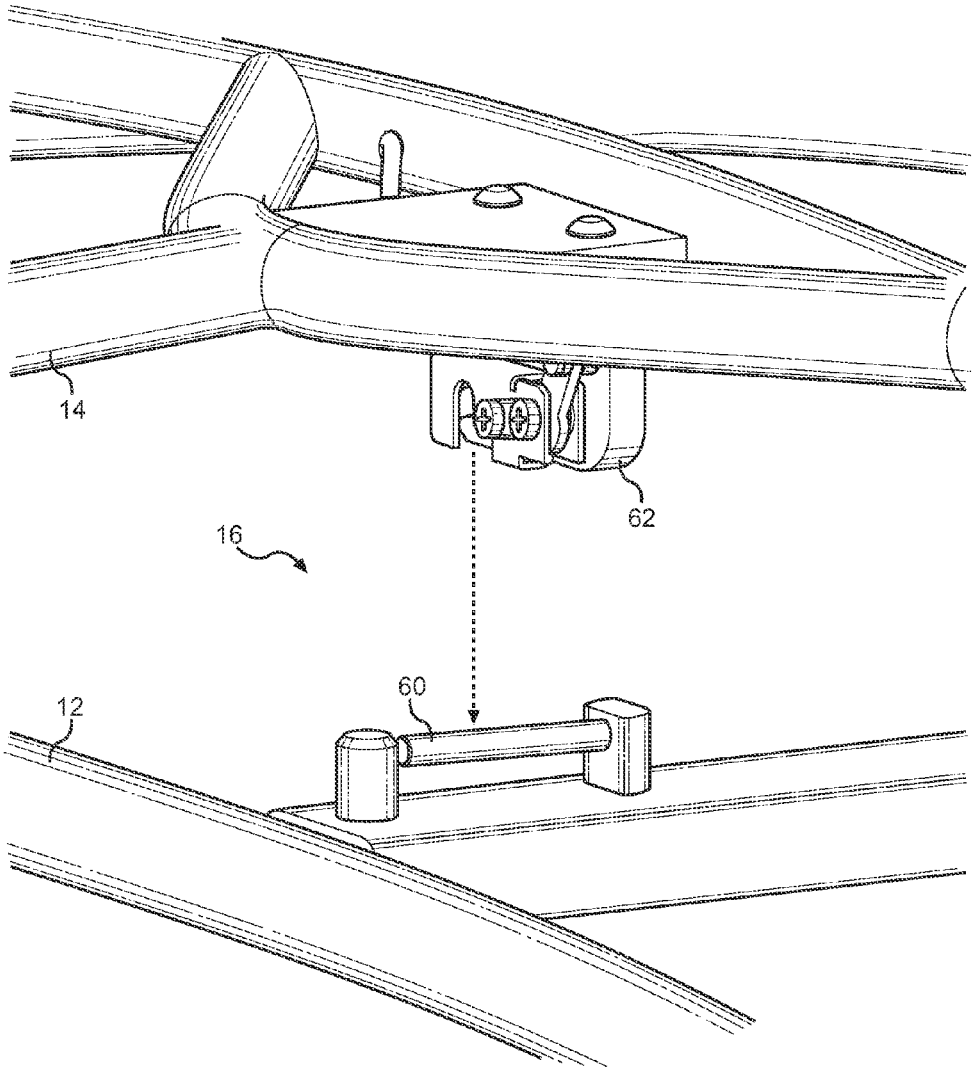
Figure 11:
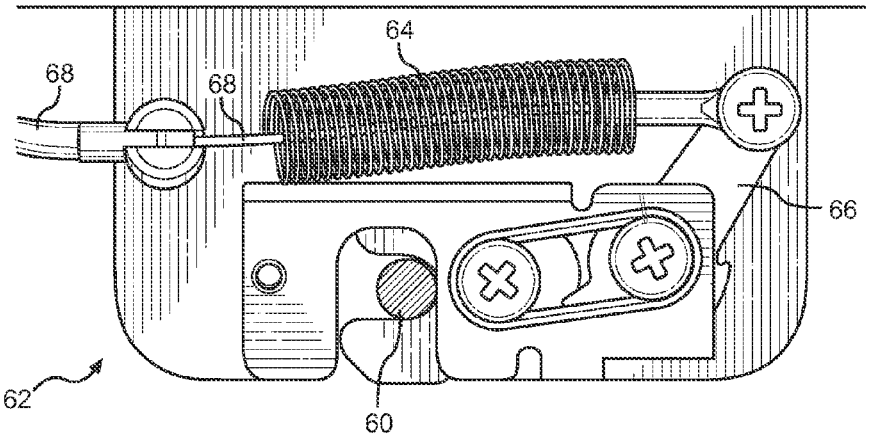
FIG. 11 is a closeup view of a release mechanism of the latch of FIGS. 9 and 10.
Figure 12:
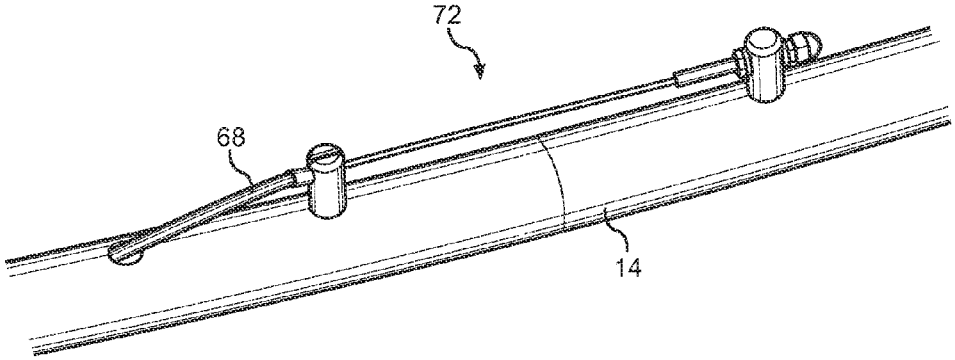
FIG. 12 is a closeup view of a remote release for the latch of FIGS. 9 and 10.
Figure 13:
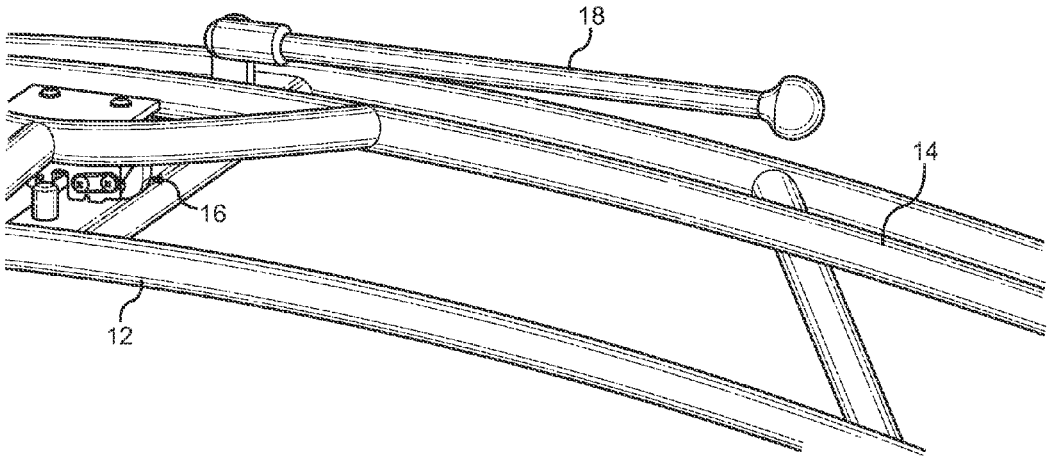
FIG. 13 shows a folding light mounted on the vertical arch.

The lateral support 14 is configured to mount to the arch member 12 to provide a rigid roof-shaped frame that cooperates with the arch 12 to support a sun cover and/or carry cargo and the like. The components of the lateral support 14 may be made of aluminum, composite, or other rigid materials. The lateral support 14 includes a pair of legs 40 and 42 that pivotally attach to the arch member 12. For example, with reference to FIG. 8, a lower end of the leg 40 may include a pivot mount 44 that pivotally attaches as by a pivot pin 46 to a fitting 48 on the arch member 12. The fittings 48 may be located on outboard sides of the legs 22 and 24 substantially at their mid-section. However, in other embodiments, the fittings may be otherwise located, such as on the aft or inboard sides of the legs 22 and 24 or on projections extending from the legs. The lateral support 14 includes a forward portion 50 that may be pivotally positioned to overlie and abut the crosspiece 20 of the arch member 12. The latch system 16 is configured to latch the forward portion 50 of the lateral support onto the crosspiece 22 to provide the deployed position of the frame 10 as shown in FIGS. 1 and 4.

Although in the illustrated embodiment, the forward portion 50 of the lateral support is facing towards the fore of the boat, in alternate embodiments, such as where the arch member 12 of the frame 10 is aft-leaning, the entire orientation of the frame may be reversed and the forward portion 50 of the lateral support may be facing towards the aft of the boat.

With reference to FIGS. 9-12, the latch system 16 includes a latch bar 60 located on the arch member 12 and a latch 62 located on the lateral support 14. The latch bar 60 provides a structure on the arch member 12 for the latch 62 to engage to latch the lateral support 14 to the arch member 12. The latch 62 is preferably a slam latch, having a spring 64. The latch 62 is activated by shutting or slamming the latch 62 onto the latch bar 60 to close the latch with the latch bar 60 engaged by the latch 62 to maintain the lateral support 14 latched to the arch member 12. The latch 62 is released from engagement with the latch bar 62 as by pulling a latch lever 66 to disengage the latch 62.

The lever 66 is preferably connected to a cable 68. The cable 68 enables remote actuation of the latch lever 66. For example, the cable 68 may be routed to a location remote from the latch 62 to facilitate access for disengaging the latch 62 from a more convenient location. If desired, the cable 68 may be routed internally within the lateral support 14 to terminate at a more accessible location, such as a rearward portion 70 of the lateral support 14. A terminal end 72 of the cable 68 may be configured to provide a handle structure or the like so that the user may pull on the terminal end 72 of the cable 68 to disengage the latch 62 from a location remote from the latch 62. It will be understood that the locations of the latch bar and the latch maybe reversed.

In the illustrated embodiment, the latch bar 60 is located centrally on the cross member 20. However, it will be understood that the latch bar 60 may be located on other portions of the cross member 20 and the latch correspondingly located on the lateral support 14. In certain embodiments, the latch system 60 may include multiple latches/latch bars, such as two located on opposite ends of the cross member 20. In other embodiments, rather than being disposed on the cross member 20, the latch/latch bar may be disposed on an upper portion of the legs 22 and 24. Furthermore, the latch system 16 may use other latch mechanisms, such as an electrical locking mechanism or other mechanical locking systems.

Figure 17:
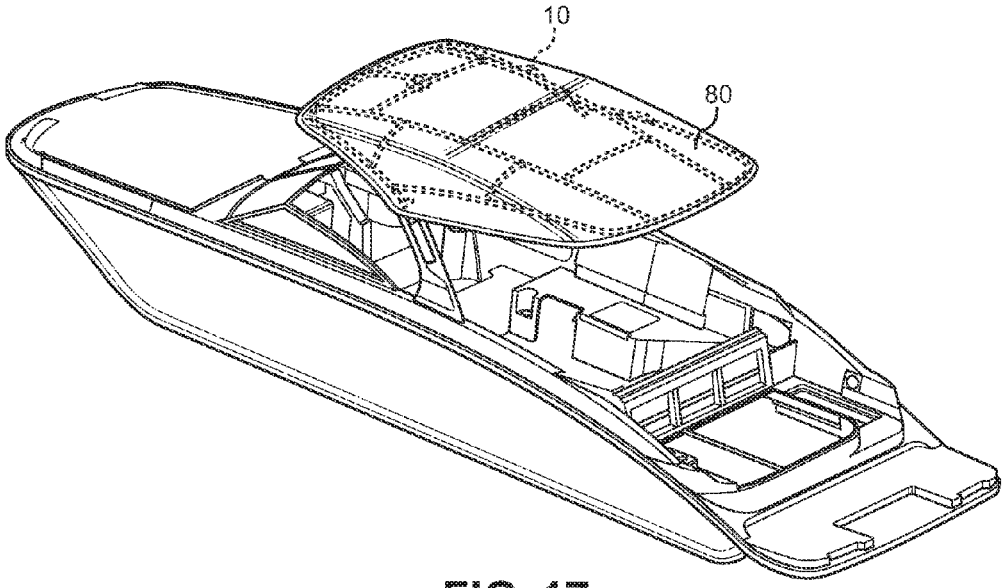
FIG. 17 shows the frame of FIG. 1 used to support a bimini cover.

With reference to FIG. 17, the lateral support 14 is configured to receive sheeting or a cover, such as a bimini cover, to provide a sun cover 80. The cover 80 may be provided as by canvas or vinyl, and includes fasteners for securing the cover 80 to the lateral support 14 and other portions of the frame 10 if desired. For example, male snaps may be located on the frame 10 and female snaps on the cover 80 to matingly engage the male snaps. Alternatively, other fasteners such as clips, cords, and the like may be used. The cover may be removable in its entirety or, in some embodiments, in sections to allow boat riders to be exposed to the sun when desired. When sections of the cover are removed, cargo can still be stored on the uncovered portions of the frame 10.

Figure 18:
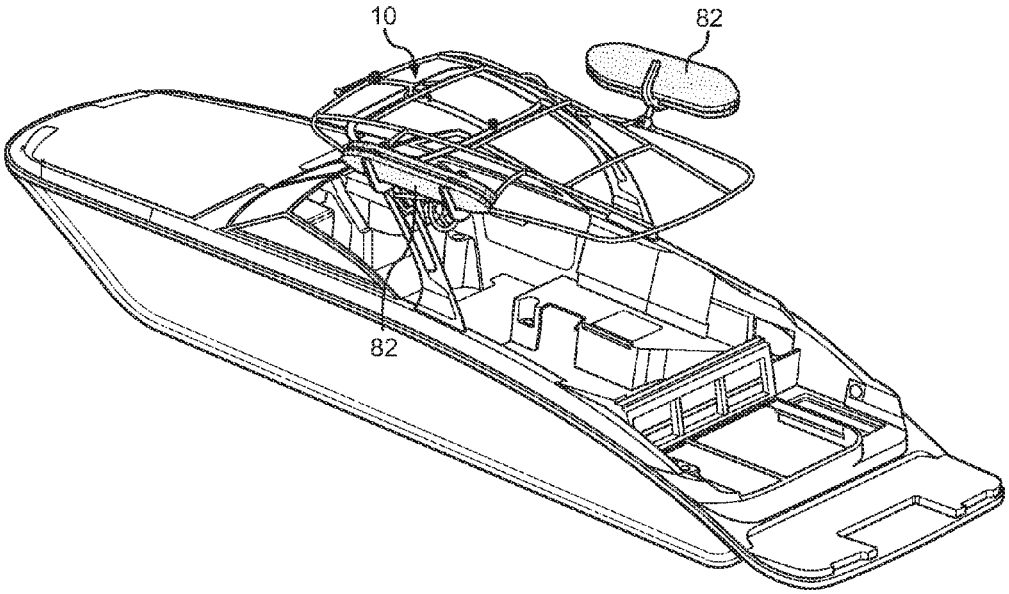
FIG. 18 shows the frame of FIG. 1 used as a cargo carrier.
Figure 19:
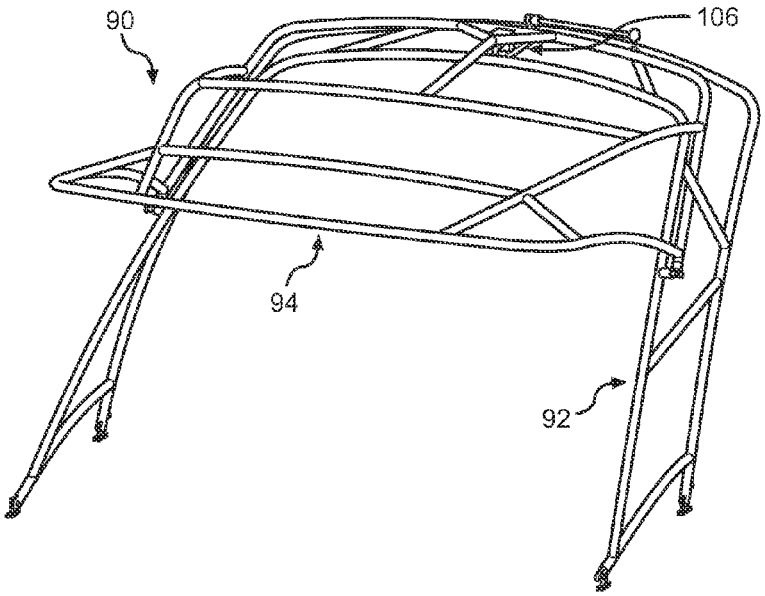
FIGS. 19-22 show an alternate embodiment of a folding frame according to the disclosure.
Figure 20:
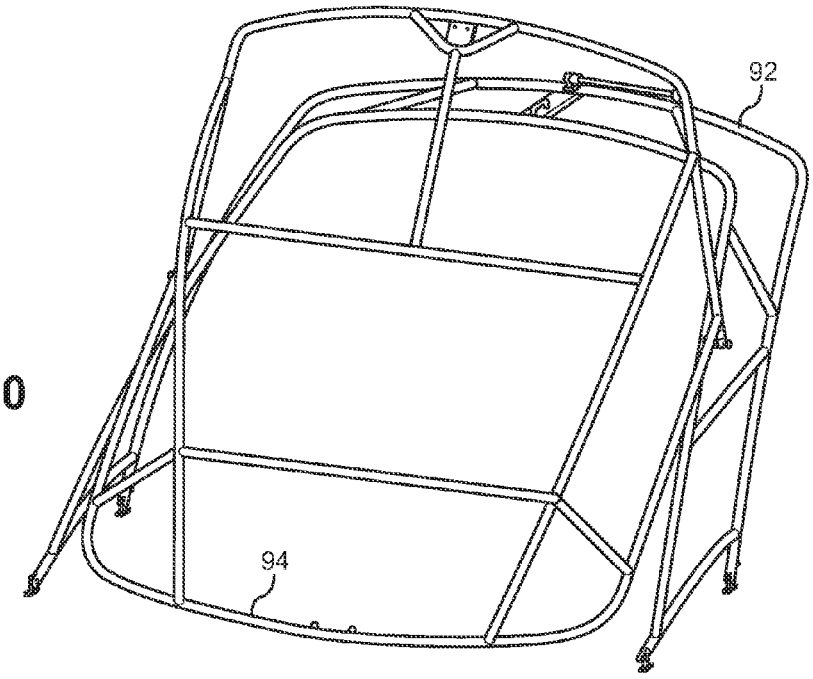
Figure 21:
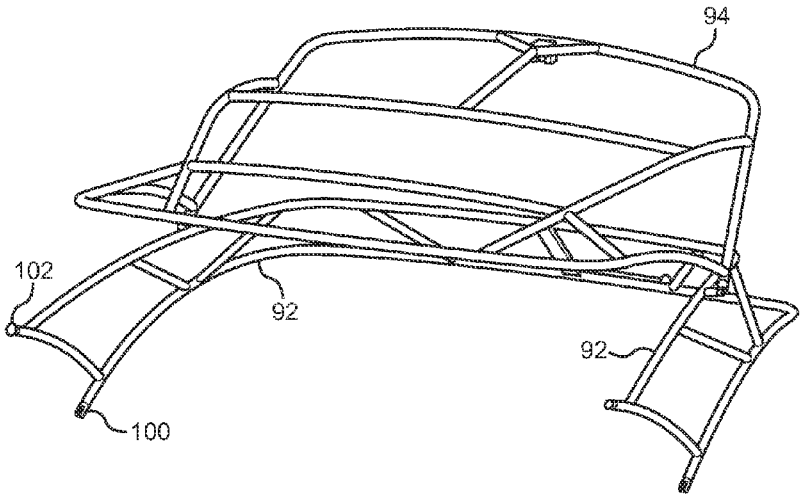
Figure 22:
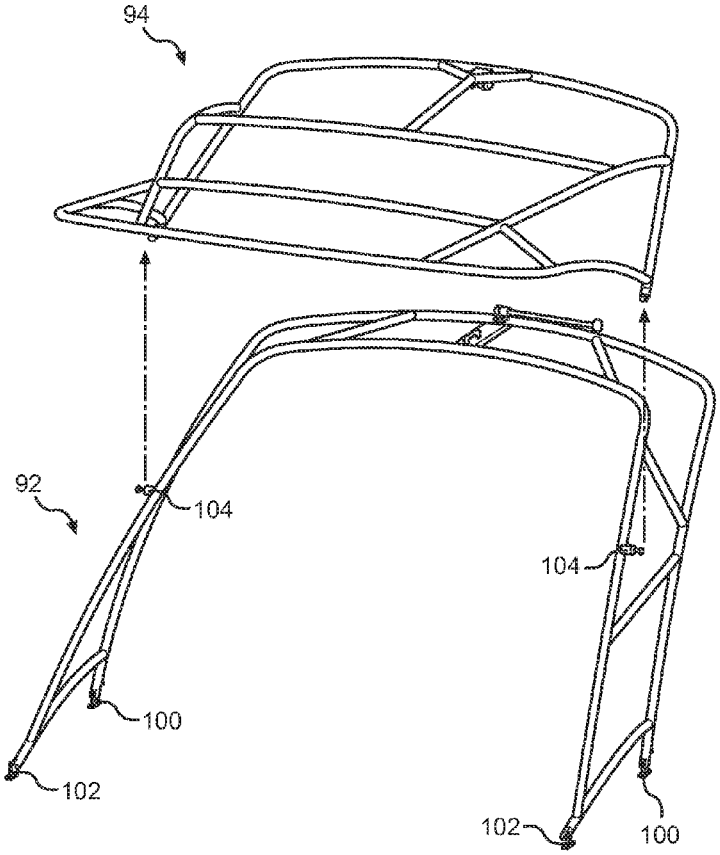

In this regard, cargo may be stored on the top of the lateral support and releasably held in position such as by straps or bungie cords. In some embodiments, the lateral support 14 may also receive brackets, clamps, mounts, and the like for mounting speakers, skis, wakeboards, surfboards, tubes, lights, and the like. For example, as shown in FIG. 18, cargo 82 may be received on mounts attached to the lateral support. As described above, releasing the lateral support 14 from the raised arch member 12 and pivoting the lateral support 14 downward provides a loading position of the frame that facilitates loading of cargo and the like.

FIGS. 19-22 show another embodiment of a folding frame 90. The frame 90 is similar to the frame 10, and includes a folding arch member 92 and a lateral support 94 pivotally mounted onto the folding arch member 92. The frame 90 differs from the frame 10 in that legs 96 and 98 mount directly to the boat as opposed to mounting to bases. In this regard, the legs 96 and 98 include pivoting mounts 100 which pivotally mount a forward portion of the legs 96 and 98 to the boat, and releasable mounts 102, which releasably mount rear portions of the legs 96 and 98 to the boat. Thus, when the releasable mounts 102 are engaged to lock the rear of the legs 96 and 98 to the boat, the pivoting mounts 100 secure the front of the legs 96 and 98 to the boat to lock the arch member 92 in a fixed upright orientation. When the releasable mounts 102 are released to free the rear of the legs 96 and 98 from the boat, the pivoting mounts 100 enable the arch member 92 to be folded. Pivot mounts 104 pivotally connect the lateral support 94 to the arch member 92 in the manner of the pivot mount 44. A latch system 106 similar to the latch system 16 enables the lateral support 94 to be latched to the arch member 92.

As will be appreciated, the frames according to the disclosure advantageously enable a strong, but foldable design. The frames features lateral supports that can be easily raised and lowered for storing and retrieving cargo, and vertical arch members that can be easily be raised or lowered to facilitate storage of the boat.

The foregoing description of preferred embodiments for this disclosure has been presented for purposes of illustration and description. It is not intended to be exhaustive or to limit the disclosure to the precise form disclosed. Obvious modifications or variations are possible light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A folding frame for a boat, the frame comprising:

a vertical arch member comprising a pair of arch legs and a cross-piece that may be pivotally raised and lowered or released relative to a boat; and a lateral support member that can receive a sun cover or cargo, and which has a first portion comprising a pair of support member legs, wherein the support member legs are pivotally connected to mid-sections of the arch legs, and a second portion that releaseably connects to the arch member adjacent an upper end of the arch member, wherein the second portion is rigidly connected to the pair of support member legs.

2. The folding frame of claim 1, wherein the arch member has a frontal portion pivotally mounted relative to the boat and a rear portion releasably mounted relative to the boat, wherein the rear portion is released from its mounting to the boat to permit the arch member to be pivotally lowered.

3. The folding frame of claim 1, further comprising a latch associated with the frame for releasably latching the lateral support member and the arch member together so that the lateral support member is fixed from pivoting relative to the arch member.

4. The folding frame of claim 3, wherein the latch is located on the arch member and the lateral support member includes a latch bar configured to cooperate with the latch to releasably yet fixedly connect the lateral support member to the arch member.

5. The folding frame of claim 4, wherein the latch comprises a spring-loaded slam latch.

6. The folding frame of claim 5, wherein the frame includes a cable operatively associated with the latch and having a terminal end portion located remote from the latch, wherein the terminal end portion of the cable may be utilized to release the latch so as to release the lateral support member from the arch member.

7. A folding frame for a boat, the frame comprising:

a vertical arch member comprising a pair of arch legs and a cross-piece;

a lateral support member that can receive a sun cover or cargo, and which has a first portion comprising a pair of support member legs, wherein the support member legs are pivotally connected to mid-sections of the arch legs, and a second portion that releaseably connects to the arch member adjacent an upper end of the arch member, wherein the second portion is rigidly connected to the pair of support member legs; and a latch associated with the frame for releasably latching the lateral support and the arch member together so that the lateral support member is fixed from pivoting relative to the arch member, wherein, the frame is positionable between:

a deployed position comprising the lateral support member oriented to be generally horizontal and latched to the arch member, and a loading position comprising the lateral support member is unlatched from the arch member and pivoted away from the arch member so that a rearward edge of the lateral support member is pivoted downwardly.

8. The folding frame of claim 7, wherein the latch is a slam latch.

9. A folding frame for a boat, the frame comprising:

a vertical arch member that may be pivotally raised and lowered or released relative to a boat;

a lateral support member that can receive a sun cover or cargo, and which has a first portion pivotally connected to the arch member and a second portion that releaseably connects to the arch member; and a latch associated with the frame for releasably latching the lateral support member and the arch member together so that the lateral support member is fixed from pivoting relative to the arch member, wherein the frame includes a cable operatively associated with the latch and having a terminal end portion located remote from the latch, wherein the terminal end portion of the cable may be utilized to release the latch so as to release the lateral support member from the arch member.

10. The folding frame for a boat of claim 3, wherein the frame is positionable between:

a deployed position comprising the arch member oriented in an upright or non-folded position, and the lateral support member oriented to be generally horizontal and latched to the arch member, a loading position comprising the arch member oriented in an upright or non-folded position, and the lateral support member is unlatched from the arch member and pivoted away from the arch member so that a rearward edge of the lateral support member is pivoted downwardly, and a stowed position comprising the arch member folded to a lowered or non-upright position, and the lateral support member positioned to be generally horizontal and latched to the arch member so as to position the frame in a vertically compact orientation.

* * * * *